US005240503A

United States Patent [19]

Levy et al.

[11] Patent Number: 5,240,503

[45] Date of Patent: Aug. 31, 1993

[54] REMOTE-CONTROLLED SYSTEM FOR TREATING EXTERNAL SURFACES OF BUILDINGS

[76] Inventors: Roni Levy, 9 Tabenkin Street, 59552 Bat Yam; Yhoshua Sheinman, 35 Bavli Street, 62917 Tel Aviv, both of Israel

[21] Appl. No.: 874,153

[22] Filed: Apr. 27, 1992

[51] Int. Cl.[5] ..... B05B 3/18

[52] U.S. Cl. ..... 118/323; 15/49.1; 51/429; 239/264

[58] Field of Search ..... 52/749; 15/50.3, 52.1, 15/98, 302, 49.1; 118/323; 239/227, 264, 692, 694, 751, 752, 173; 151/429

[56] References Cited

U.S. PATENT DOCUMENTS 3,298,052 1/1967 Wolfe ..... 15/50.3
3,349,454 10/1967 Mikalson ..... 15/50.3
3,606,162 9/1971 Lehman ..... 239/227
3,641,607 2/1972 Lemelson ..... 15/50.3

*Primary Examiner*—W. Gary Jones
*Assistant Examiner*—Dean Tan Nguyen
*Attorney, Agent, or Firm*—Mark M. Friedman

[57] ABSTRACT

A system for treating a surface, such as the outside surfaces of a tall building which can be operated remotely without the need to place a worker in close proximity of the surface to be treated. The system includes a vertical supporting column onto which is mounted a treatment unit. The treatment unit can carry out washing, painting, sandblasting, and similar operations and includes mechanisms for allowing the working head of the unit to be angles with respect to, as well as to move parallel to and perpendicular to, the surface being treated. In another embodiment, a window cleaning unit is suspended from the roof and is allowed to descent while cleaning the exterior surfaces of the windows.

13 Claims, 3 Drawing Sheets

FIG 1
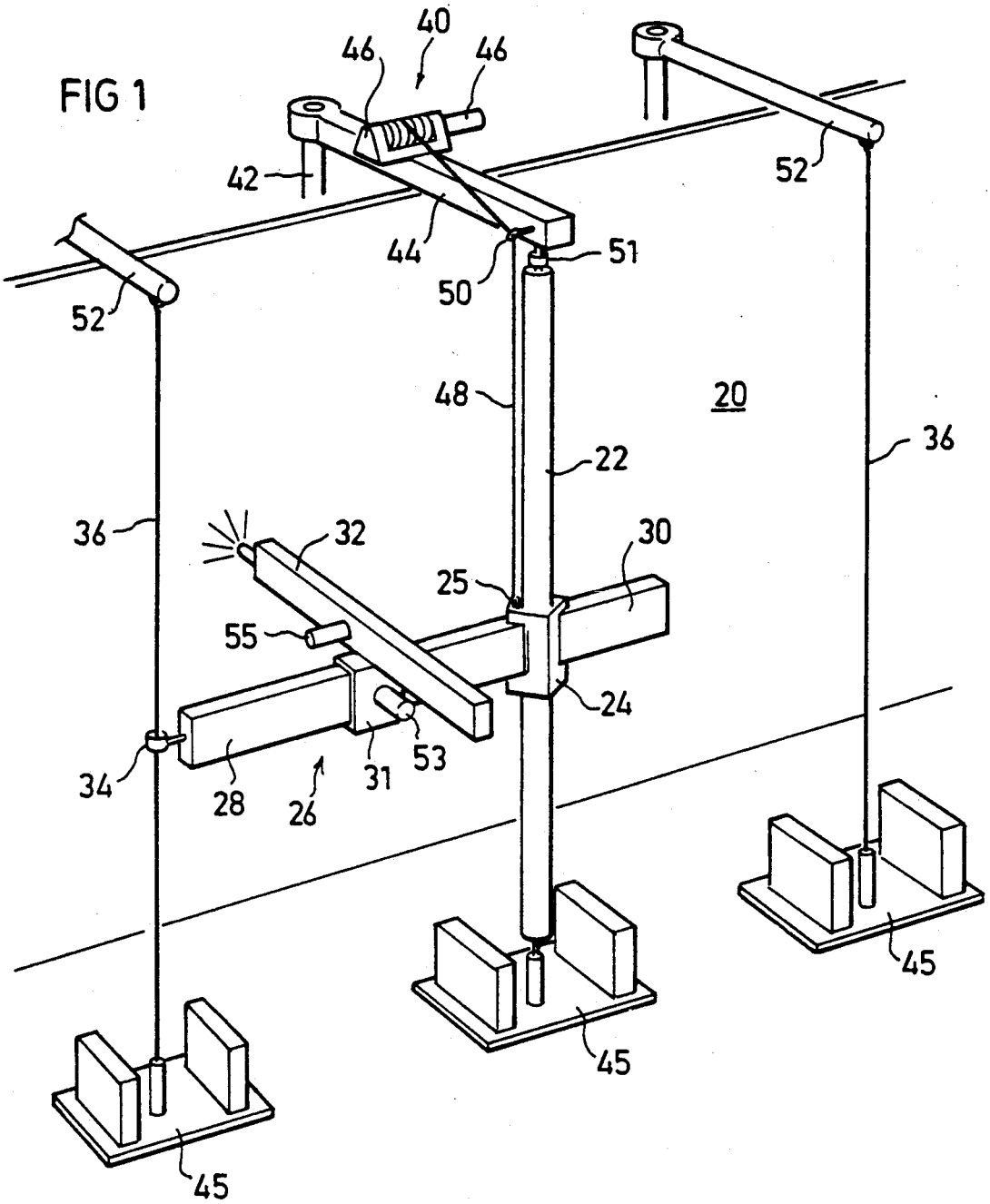
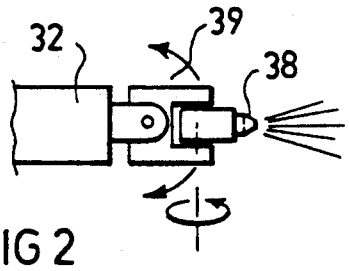
FIG 2

REMOTE-CONTROLLED SYSTEM FOR TREATING EXTERNAL SURFACES OF BUILDINGS

FIELD AND BACKGROUND OF THE INVENTION

The present invention relates to remotely-controlled systems for treating external surfaces of buildings and, more particularly, to remotely-controlled systems which make it possible to paint, wash and carry out other treatments of the outside of a building, including the outside of its windows.

Tall buildings are quite commonplace, especially in heavily populated areas. The external surfaces of such buildings must occasionally be treated for aesthetic and/or functional reasons. For example, it is desirable to periodically clean the outside surfaces of the building windows, which windows often form an integral part of the building exterior and cannot be accessed from inside the building. It may also from time to time be desirable to clean surfaces other than the windows. Similarly, it may be desired to paint or otherwise coat portions of the exterior surface of buildings.

A number of techniques are used in order to gain access to the building exterior for the purpose of effecting any of the above-mentioned treatments, among others. A very small fraction of buildings are designed with external access ways surrounding each floor which can accommodate a worker. However, the vast preponderance of buildings, for reasons of cost and/or architectural aesthetic considerations, do not feature such access ways.

To treat the external surfaces of buildings lacking external access ways, one normally relies on scaffolding capable of accommodating one or more workers. For large undertakings, such as the repainting of the exterior of a building, weeks may be required to erect the necessary scaffolding.

For smaller jobs, such as the cleaning of exterior windows, a small scaffold platform may be supported by cables which are attached to an appropriate securing device secured at the roof of the building. A motor located on the roof or on the platform is used to raise and lower the scaffold platform. The securing device can be moved as necessary to the appropriate location on the roof so as to allow access of workers on the platform to the precise portion of the building exterior to be treated. Some buildings feature a series of permanently installed securing devices located at desired locations along the roof, which obviates the need to move and redeploy a mobile anchoring device.

A difficulty shared by all the above-described techniques is that each requires a worker to work in the immediate vicinity of the portion of the exterior surface of the building being treated. This involves a number of disadvantages. First, the worker is exposed to various dangers such as the danger of falling off the platform or access way because of external forces, such as winds. Such accidents can also come about as a result of human error, induced by the highly constrained space in which the worker must operate. In addition, use of the above-described techniques puts the worker in very close proximity to the cleaning and painting materials which are being used, thereby exposing the worker to potentially dangerous materials. The adverse effects of inhaling various chemicals, such as paints, are well known. Finally, the work involved is, by its nature, highly repetitive and mechanical, which may detrimentally affect the speed and/or quality of the job done by a human worker.

There is thus a widely recognized need for a system for treating the outside surfaces of buildings which can be controlled remotely without requiring the presence of a human worker in close proximity of the surface being treated.

It would be desirable and highly advantageous to have a system which could be readily deployed to quickly and efficiently treat, as by washing, painting, etc., the exterior surfaces of virtually any building, without the need to locate one or more workers in the immediate vicinity of the portion of the building exterior being treated.

SUMMARY OF THE INVENTION

According to the present invention there is provided a system for treating an external surface of a building, comprising: (a) a vertical supporting member; (b) a connector mounted onto the supporting member and slidable along the supporting member; (c) first driving means for moving the connector along the supporting member; (d) treatment means movably connected to the connector for treating the surface; (e) second driving means for moving the treatment means in rectangular Cartesian coordinates relative to the surface of the building; (f) means for securing the supporting member to the building; (g) means for anchoring the supporting member; (h) means for controlling the first driving means; and (i) means for controlling the second driving means.

In another embodiment according to the present invention, the system further includes a guiding system for keeping said treatment means properly oriented with respect to the surfaces of the building.

The present invention is of a system which can be used to treat exterior surfaces of a relatively tall structure, such as a multi-story building, or a skyscraper. The treatment can include the washing of the surfaces, such as windows, the painting of all or portions of the surface, the plastering of the surface or its treatment with a protective coating, such as a protective coat for the purpose of water proofing the surface, and similar tasks. The treatments are carried out by an automated system without the need for a worker to be located in the immediate vicinity of the surface being treated. The system is controlled remotely by an operator located a safe distance away. Control commands can be sent via wire or can be transmitted wirelessly.

In one embodiment of systems according to the present invention, the contour of the surfaces to be treated is made known to the system which proceeds to automatically treat the surfaces, without the need for human intervention.

In another alternative embodiment of a system according to the present invention, the system is equipped with a television camera which transmits real-time images of the surface to the remotely-located operator.

A system according to the present invention includes a vertical supporting column onto which is mounted a slidable structure which includes the treatment means. The treatment means includes devices which make it possible for the structure to move parallel to and perpendicular to the surface.

A system according to the present invention also includes a guiding system, which may include one or more guide wires extending parallel to the supporting column which connect to the platform in order to ensure that the platform remains fixed relative to the surface during operations.

The supporting column, as well as the guide wires are secured to the building above the surface to be treated, typically onto the roof of the building. The lower portions of the supporting columns and guide wires are anchored below the surface to be treated, typically to the ground.

Systems according to the present invention successfully address the shortcomings of presently known configurations by providing a way of safely accurately and quickly treating exterior surfaces of buildings without the need to place a worker in the immediate vicinity of the surface being treated and without the need to build expensive and potentially dangerous scaffolding.

BRIEF DESCRIPTION OF THE DRAWINGS

The invention is herein described, by way of example only, with reference to the accompanying drawings, wherein:

FIG. 1 is an overall view of a device for treating the exterior surfaces of buildings according to the present invention;

FIG. 2 is a close-up view of the nozzle of FIG. 1 and its mounting;

DESCRIPTION OF THE PREFERRED EMBODIMENTS

Figure 3:
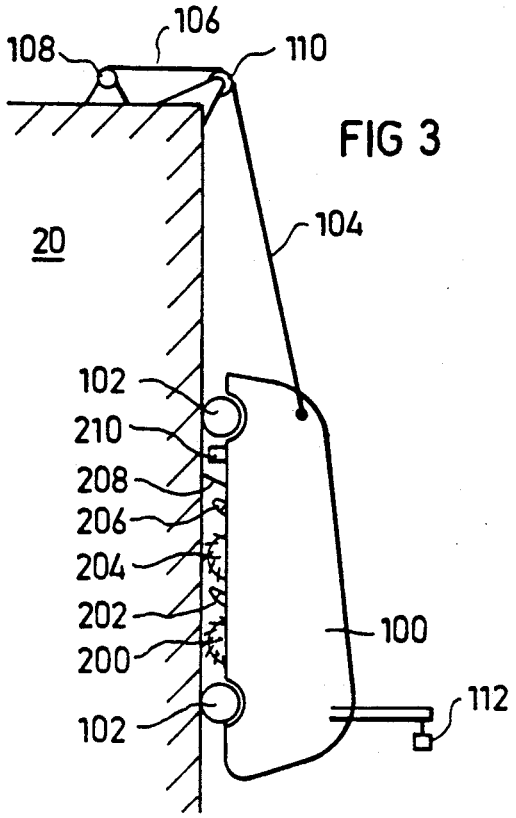
FIG. 3 is a side view of a device according to the present invention particularly suitable for washing windows.

The present invention is of systems for treating the exterior surfaces of tall structures, such as buildings, which can be quickly and easily implemented and which do not require the presence of a worker in the immediate vicinity of the surface being treated.

The principles and operation of systems according to the present invention may be better understood with reference to the drawings which depict various aspects of several illustrative systems according to the present invention.

Referring now to the drawings, FIG. 1 is an overall view of a system according to the present invention. The system depicted can be used to treat the exterior surfaces 20 of a building. The system includes a supporting member 22, which is preferably a substantially vertically oriented column of circular or polygonal cross section. Supporting member 22 is preferably assembled from conveniently sized lengths or modules which can be rapidly assembled on-site, such as by snapping together short lengths, to give a complete full-length supporting member 22.

Support member 22 is connected to the building at a point above the surface being treated. Preferably, support member 22 is connected to a securing mechanism, generally designated 40, which is, in turn, connected to the roof of the building.

Securing mechanism 40 typically includes a base element 42 which is connected to the roof in some convenient fashion. Base element 42 is attached to a cross member 44 which extends away from, and overhangs, the building. Near its extended end, cross member 44 is connected to supporting member 22. A small cable lifting device is attached to cross member 44 and is used to lift supporting member 22.

Systems according the present invention also feature driving means for moving connector 24 and its associated equipment along supporting member 22 to a desired vertical location. Any suitable driving means may be used. For example, shown in FIG. 1 is a driving means which includes a roller 46 mounted on cross member 44 which is driven by an adjoining motor 46. Wound onto roller 46 is a drive cable 48 which is connected at its far end to connector 24 through a hook 25. The orientation of cable 48 is imparted to it by a directional pulley 50 located near the extended end of cross member 44. Turning of roller 46 serves to lower or raise connector 24 and the associated equipment attached to connector 24.

Securing mechanisms 40 can also be used in the construction of supporting member 22 by lifting into place the modules which make up supporting member 22. Supporting member 22 features at its upper end a lifting hook and a universal joint 51 which can be quickly snapped into cross member 44. Universal joint 51 obviates the need for orienting supporting member 22 perfectly vertically.

The lower end of supporting member 22 is anchored at a point below the portion of surface 20 to be treated. Typically, the anchoring is to the ground, by use of an anchoring unit 45 which may include ballast such as refillable water containers and a quick connect mechanism for ready connection to supporting member 22.

Mounted onto supporting member 22 is a structure, which for convenience will be termed a connector 24. Connector 24 may be mounted onto supporting member 22 in any convenient manner. Connector 24 is slidable along supporting member 22 and is capable of assuming any desired intermediate position between a location near the top of supporting member 22 and near its bottom.

Connected to connector 24 in some suitable fashion is a device for carrying out the actual treatment of surfaces 20, generally designated as treatment means 26. Treatment means 26 may take on any of a large variety of forms. Depicted in FIG. 1 is one illustrative configuration which includes a parallel member 28 which lies roughly parallel to surface 20 and which is connected to connector 24.

In a preferred embodiment, the device features a single parallel member 28 which extends only to one side of connector 24. The opposite side of connector 24 may feature an appropriately sized and shaped counterweight 30 to counterbalance the weight of parallel member 28 and the components resting thereon to be described below.

In an alternative embodiment (not shown) two parallel members 28 are symmetrically connected to connector 24, one on each side. This allows two adjoining portions of building surface 20 to be treated simultaneously and eliminates the need for a counterweight.

Mounted onto parallel member 28 in any convenient fashion is a secondary connector 31 to which is connected a perpendicular member 32. Secondary connector 31 includes wheels for sliding with respect to parallel member 28. Secondary connector 3 is capable of sliding with precision along parallel member 28 to any desired location. Driving force for such motion may be supplied by a first motor 53. Perpendicular member 32 is moved perpendicular to surface 20 with the aid of bearings. Driving force for such motion may be supplied by a second motor 55.

Perpendicular member 32 is capable of precisely moving perpendicular to surface 20 to any desired position with respect to surface 20. At the anterior end of perpendicular member 32 is located a universal distance measurement device which is capable of indicating and controlling the precise distance from the anterior end of perpendicular member 32 to wall 20.

Near the end of perpendicular member 32 closer to surface 20, perpendicular member 32 features a tool 38 used for the treatment of surface 20. Tool 38 is typically a nozzle for the spraying of water or paint, but may be any one of a large number of possible devices useful in treating surface 20. Tool 38 is mounted onto perpendicular member 32 in such a way that it is capable of moving in any direction relative to wall 20. This is preferably accomplished, as shown in FIG. 2, by mounting tool 38 onto perpendicular member 32 using a universal joint connection 39.

At or near the end of parallel member 28 farthest from supporting member 22 is mounted a guide wire receiver 34 for releasably holding a guide wire 36. The holding of guide wire 36 by guide wire receiver 36 serves to stabilize parallel member 28 and hold it at a fixed orientation relative to surface 20. The fixing of the orientation of parallel member 28 makes it possible for the treatments of surface 20 to be carried out in a precise manner.

Guide wire 36 is held in its desired position by a system not unlike that used to fix supporting member 22. The upper end of guide wire 36 is attached to a guide wire cross member 52 which is preferably connected to the roof of the building through a guide wire base element 54. The lower portion of guide wire 36 is anchored, typically to the ground, using anchoring units 45 similar to those used to anchor support member 22.

Preferably, two guide wire systems are deployed, one on either side of supporting member 22. Once the surface of the building to one side of supporting member 22 has been treated throughout its entire vertical extent, guide wire 36 holding parallel member 28 is released, perpendicular member 32 is rotated 180 degrees, and the entire device is rotated about connector 24 180 degrees. Once so rotated, parallel member 28 is secured to the other guide wire 36. In this position, the surface of the building on the other side of supporting member 22 can now be treated.

In an alternative embodiment of a system according to the present invention, a guiding system such as the one described above is completely eliminated. In such a system, the stabilization of parallel member 28 and the achievement of its desirable orientation relative to surface 20 is accomplished through the use of a pair of substantially parallel supporting member 22. Parallel member 28 features a pair of connectors 24, one at each of its ends, each connector 24 being mounted onto one of supporting members 22.

The treatments carried out by a system according to the present invention can include the cleaning of windows and other surfaces, painting, sand blasting, and the like. Tool 38 is equipped to supply one or more substances, alternatively, simultaneously or sequentially, typically in liquid or gaseous form, to the surface being treated. The system includes provision for storing and delivering the various fluids to tool 38. Storage of the various fluids is conveniently achieved at a point above the surface being treated, preferably on the roof of the building. Delivery of the various fluids can be carried out with the help of pumps and/or compressors.

Systems according to the present invention are remotely controlled. In one embodiment, control is supplied fully automatically from a control unit which has been pre-programmed to carry out a specific task. The pre-programming includes the accurate description of the location, in three dimensions, of surfaces to be treated and the precise nature of the treatment to be carried out. In this mode of operation, the operator simply gets the system to a desired starting point and then activates the automatic treatment system.

In another embodiment, systems according to the present invention can be operated semi-automatically with a remotely-located operator, preferably located on the ground and away from any harmful sprays, manipulating controls to operate the system. The operator may base his control on direct observation of the operation of the system. Preferably, the operator is located within a comfortable enclosure, such as a controlled-environment trailer, and is able to observe the progress of the system through real-time video images transmitted from a camera appropriately located on the device. The operator is able to remotely control the direction and zoom of the camera, in addition to being able to control the treatment device itself. Control signals can be transmitted to the system through a communications cable or wirelessly.

To deploy a system according to the present invention one proceeds as follows. The various components of the system are delivered to the work site. Securing mechanism 40 is installed on the roof, as are the comparable devices used to secure the top of guide wires 36. The various supply tanks, pumps and compressors are installed on the roof and supply lines from the various tanks are attached to the treatment mechanism.

Supporting member 22 is assembled from modular segments and is suspended onto securing mechanism 40. Guide wires 36 are similarly suspended. Anchoring devices are installed and the lower portion of supporting member 22 is attached to an anchoring device, as are the lower portions of guide wires 36.

Connector 24 with all the associated equipment is mounted onto supporting member 22 and is attached to drive cable 48. Parallel member 28 is attached to guide wire 36. The system is now ready for operation.

Figure 6:
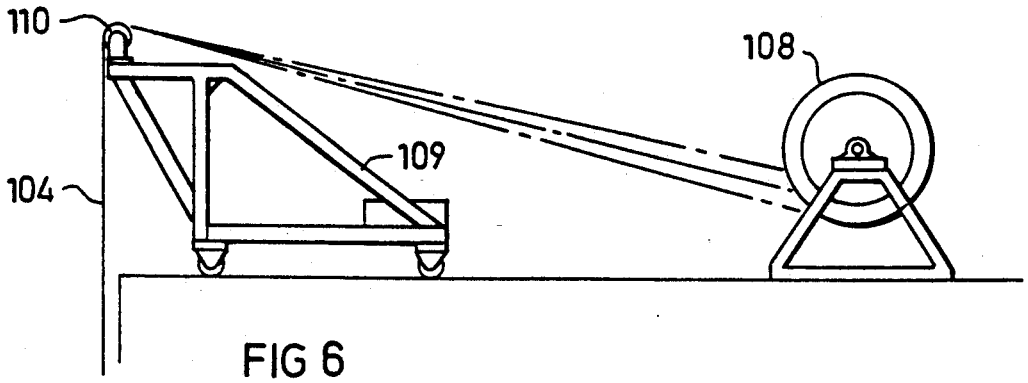
FIG. 6 is a side view of the roof installations for use in conjunction with the device of FIG. 3.

Another possible system for the treating of external building surfaces, particularly adapted for the washing of exterior windows, is shown in FIG. 3. The device includes a treatment unit 100 which features wheels 102 on its side nearest the surface 20 to be cleaned. Treatment unit 100 is suspended via a cable 104 and a securing system 106 to the roof the building. Securing system 106 include a roller 108 and a directional pulley 110. Shown in FIG. 6 is an expanded view of the supporting structures located on the roof. Specifically, shown are roller 108 onto which is mounted cable 104 as well as any supply lines, such as water and electrical lines. Also shown is the support structure 109 for directional pulley 110.

Figure 7:
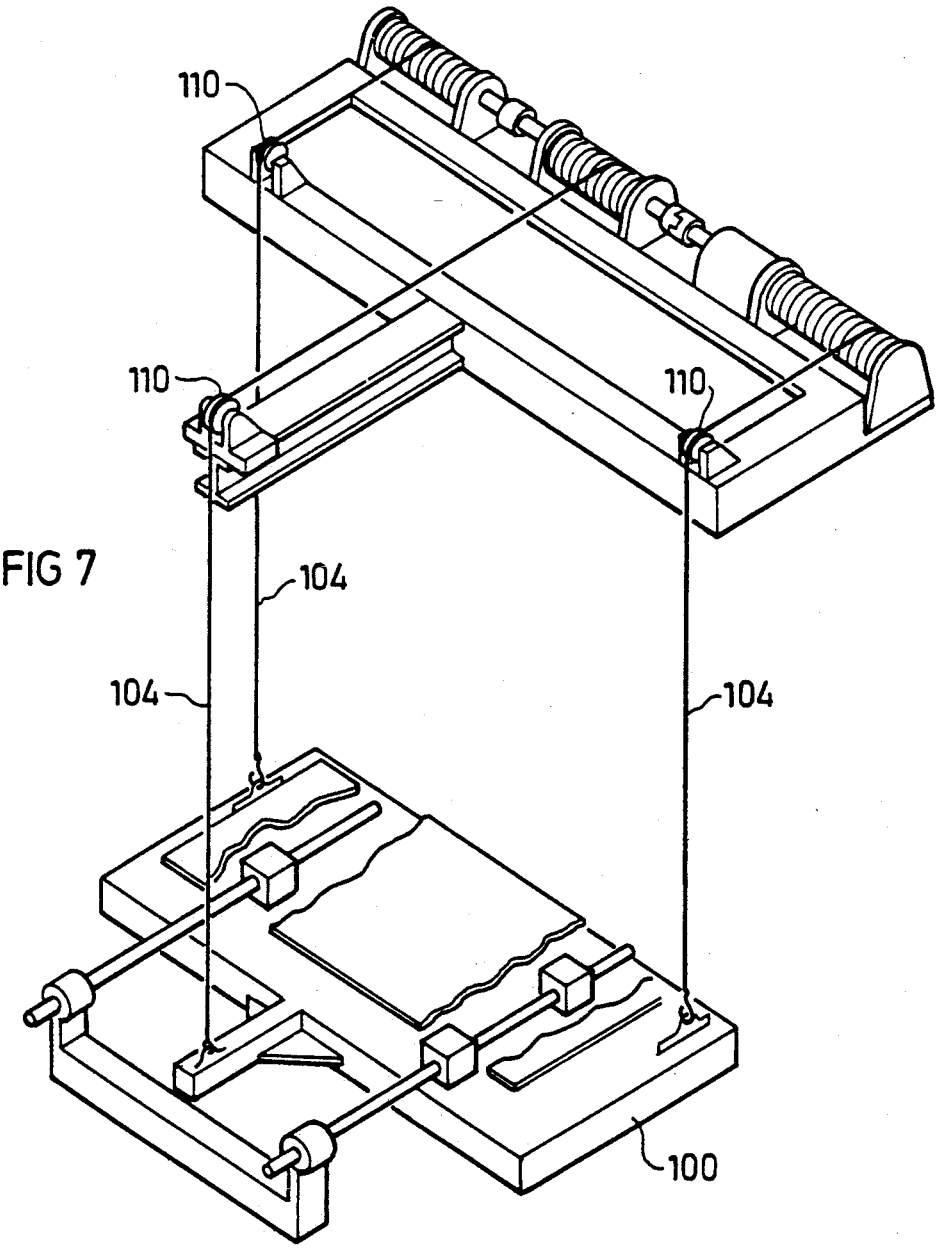
FIG. 7 is a view of an alternative mounting of a device as in FIG. 3.

An alternative suspension mechanism is shown in FIG. 7 wherein three cables 104, rather than one, are used to suspend treatment unit 100.

In operation, treatment unit 100 is let down at an appropriate rate along surface 20. Wheels 102 ride along surface 20 to maintain the proper distance between the various cleaning mechanisms and the surfaces being cleaned. Wheels 102 are kept in contact with surface 20 by a weight 112 which is suspended from treatment unit 100 and which produces sufficient torque as to pin the lower wheels 102 to surface 20.

Figure 4:
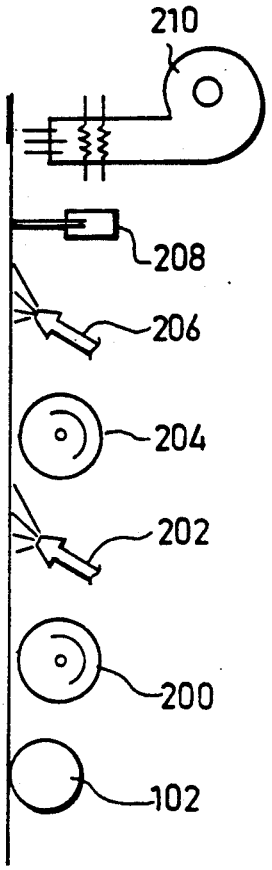
FIG. 4 is a schematic view of the various functions of the device of FIG. 3.
Figure 5:
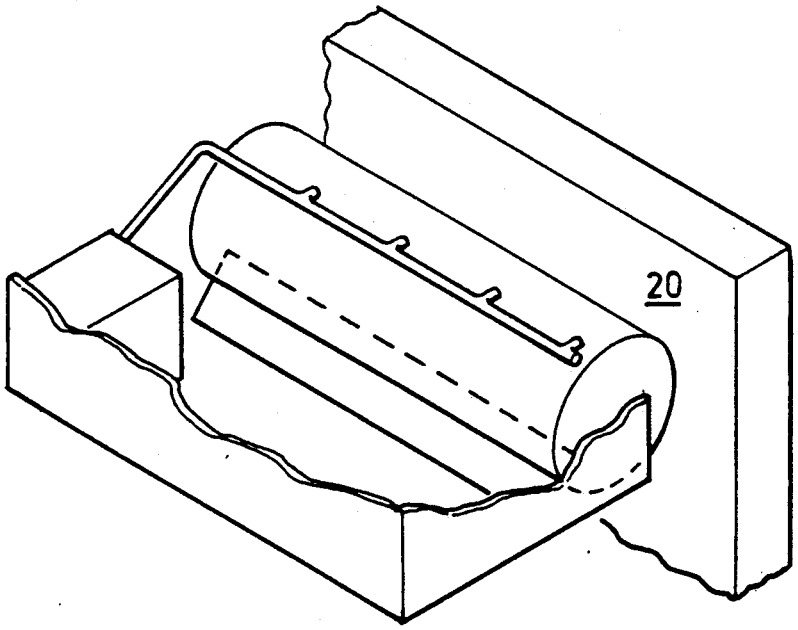
FIG. 5 is a close up view of one of the rollers of FIG. 4.

The surface of treatment unit 100 nearest building surface 20 includes one or more mechanisms serving to carry out all or part of the cleaning functions. The various mechanisms are mounted in the proper sequence, considering the downward motion of treatment unit 100 during operation. These can be seen in more detail in FIG. 4.

Preferably, the cleaning mechanisms include a primary brush 200, located near the lower end of treatment unit 100, which is capable of removing relatively large items of debris from the window. The next mechanism is preferably a primary spray nozzle 202 through which water containing detergent is sprayed. This is followed by a secondary brush 204 which is finer than primary brush 200 and which is capable of removing finer particles from the surface. A secondary spray nozzle 206, capable of spraying clean water for washing off the detergent and the debris, follows. Farther toward the upper end of treatment unit 100 is a squeegee blade 208 for removing large amounts of water from the window. Finally, near the upper end of treatment unit 100 is a hot air drier 210 capable of removing by evaporation the last remnants of water, leaving a clean and dry window surface. Treatment unit 100 includes a water and/or detergent supply tank with recycling and filtering capabilities.

While the invention has been described with respect to a number of preferred embodiments, it will be appreciated that many variations, modifications and other applications of the invention may be made.

What is claimed is:

1. A system for treating an external surface of a building, comprising:

(a) a rigid vertical supporting member;

(b) a connector mounted onto said supporting member and slidable along said supporting member;

(c) first driving means for moving said connector along said supporting member;

(d) treatment means movably connected to said connector for treating the surface;

(e) second driving means for moving said treatment means parallel to and perpendicular relative to the surface of the building;

(f) means for securing said supporting member to the building and said supporting member extending from ground level to said securing means;

(g) means for anchoring to the ground said supporting member;

(h) means for controlling said first driving means; and (i) means for controlling said second driving means;

(k) means for guiding said treatment means properly oriented with respect to the surface of the building.

2. A system as in claim 1 wherein said supporting member is made up of a plurality of detachably connected modules.

3. A system as in claim 1 wherein said supporting member is of polygonal cross section.

4. A system as in claim 1 wherein said treatment means includes a working head.

5. A system as in claim 4 said treatment means is capable of moving said working head in all directions parallel to and perpendicular to the surface.

6. A system as in claim 4 wherein said treatment means is capable of orienting said working head at various angles.

7. A system as in claim 1 wherein said guiding system includes a vertical guide wire to which said treatment means can be detachably connected.

8. A system as in claim 1 wherein said first driving means includes a wire and a winch.

9. A system as in claim 1 wherein said treatment means is capable of cleaning.

10. A system as in claim 1 wherein said treatment means is capable of painting.

11. A system as in claim 1 wherein said treatment means is capable of sandblasting.

12. A system as in claim 1 wherein said treatment means is capable of plastering.

13. A system as in claim 1 wherein said treatment means is capable of applying protective coating.

* * * * *